United States Patent [19]

Allen et al.

[11] 3,976,019

[45] Aug. 24, 1976

[54] POSITION SENSING DEVICE FOR SEWING INSTRUMENTALITY ACTUATOR

[75] Inventors: John Wesley Allen, Hudson; William P. Waiwood, Parma, both of Ohio

[73] Assignee: The Singer Company, New York, N.Y.

[22] Filed: Oct. 30, 1974

[21] Appl. No.: 519,374

[52] U.S. Cl. ..... 112/158 E; 336/30; 336/135; 112/121.11

[51] Int. Cl.[2] ..... D05B 3/02; D05B 19/00

[58] Field of Search ..... 336/135, 30, 45; 318/653; 336/232; 112/219 A, 121.11, 121.12, 158 E

[56] References Cited

UNITED STATES PATENTS

| | | | |
|---|---|---|---|
| 2,935,875 | 5/1960 | Eggers et al. | 336/30 X |
| 3,158,826 | 11/1964 | Beck | 336/30 |
| 3,757,232 | 9/1973 | Matsuda | 112/219 A X |

FOREIGN PATENTS OR APPLICATIONS

| | | | |
|---|---|---|---|
| 783,549 | 9/1957 | United Kingdom | 336/135 |

*Primary Examiner*—Werner H. Schroeder
*Assistant Examiner*—Peter Nerbun
*Attorney, Agent, or Firm*—Robert E. Smith; Edward L. Bell; Julian Falk

[57] ABSTRACT

A sewing machine is disclosed having electromechanical actuators for controlling the stitch forming instrumentalities in the formation of stitch patterns with a non-contact position sensing device associated with each electromechanical actuator comprising spaced coils and a metallic shunt plate arranged adjacent and shiftable relatively to the coils in response to movement of the actuator to produce a measureable variation in the inductance of the coils which bears an advantageous linear relationship to the electromechanical actuator position.

7 Claims, 5 Drawing Figures

POSITION SENSING DEVICE FOR SEWING INSTRUMENTALITY ACTUATOR

BACKGROUND OF THE INVENTION

One type of electromechanical actuator for influencing sewing machine stitch patterns operates in association with a servo-system comparing input signals related to the stitch pattern being executed with reference signals related to the existing position of the actuator. A conventional potentiometer comprising a coil with a wiper having contact relatively movable along the coil and functioning as a voltage divider would involve distinct disadvantages when utilized to provide positional reference signals for such a sewing machine actuator. Wear occurring because of the contact between the parts can be troublesome, especially since extended periods of sewing machine operation occur in particular positions such as the straight stitch position and because of dither motions occurring in such frequently used positions the conventional potentiometer will wear quickly at certain points.

Those non-contact position sensing devices which are known for use other than in sewing machine applications, would not serve satisfactorily in place of the device of the present invention for one or more of the following reasons:

Known non-contact position sensing devices involve high inertia effects which would be detrimental to the effective operation of the electromechanical sewing machine actuator.

Known non-contact position sensing devices do not exhibit sufficiently linear response ranges.

Known non-contact position sensing devices generate objectionable radio interference.

The large size of known non-contact position sensing devices and the requisite shielding required with them would require inordinately large space and such devices would not be adapted for accommodation within the crowded space available within a sewing machine frame.

SUMMARY OF THE INVENTION

It is an object of this invention to provide a non-contact position sensing device usable with a sewing machine actuator which will have a linear response over the operating range of the actuator and will impose a minimal inertia effect upon the actuator. This object is attained by the provision of a shunt member shiftable in association with a sewing machine actuating member and arranged for movement relatively to a pair of coils. The arrangement is such that shift of the shunt member will change the induction of the coils due to eddy currents induced into the shunt member generating magnetic fields opposite to those generated by the coils.

The position sensing device of this invention is additionally advantageous as applied to an electromechanical actuator of a sewing machine because the device may be made very light in weight and small in size, and because the device has its greatest accuracy and stability in the mid-position corresponding to center middle position of a sewing machine actuator which position is frequently repeated.

DESCRIPTION OF THE DRAWINGS

With the above and additional objects and advantages in view, as will hereinafter appear, this invention comprises the devices, arrangements, and combinations of parts hereinafter described and illustrated in the accompanying drawing of a preferred embodiment in which.

DESCRIPTION OF THE PREFERRED EMBODIMENT

Figure 1:
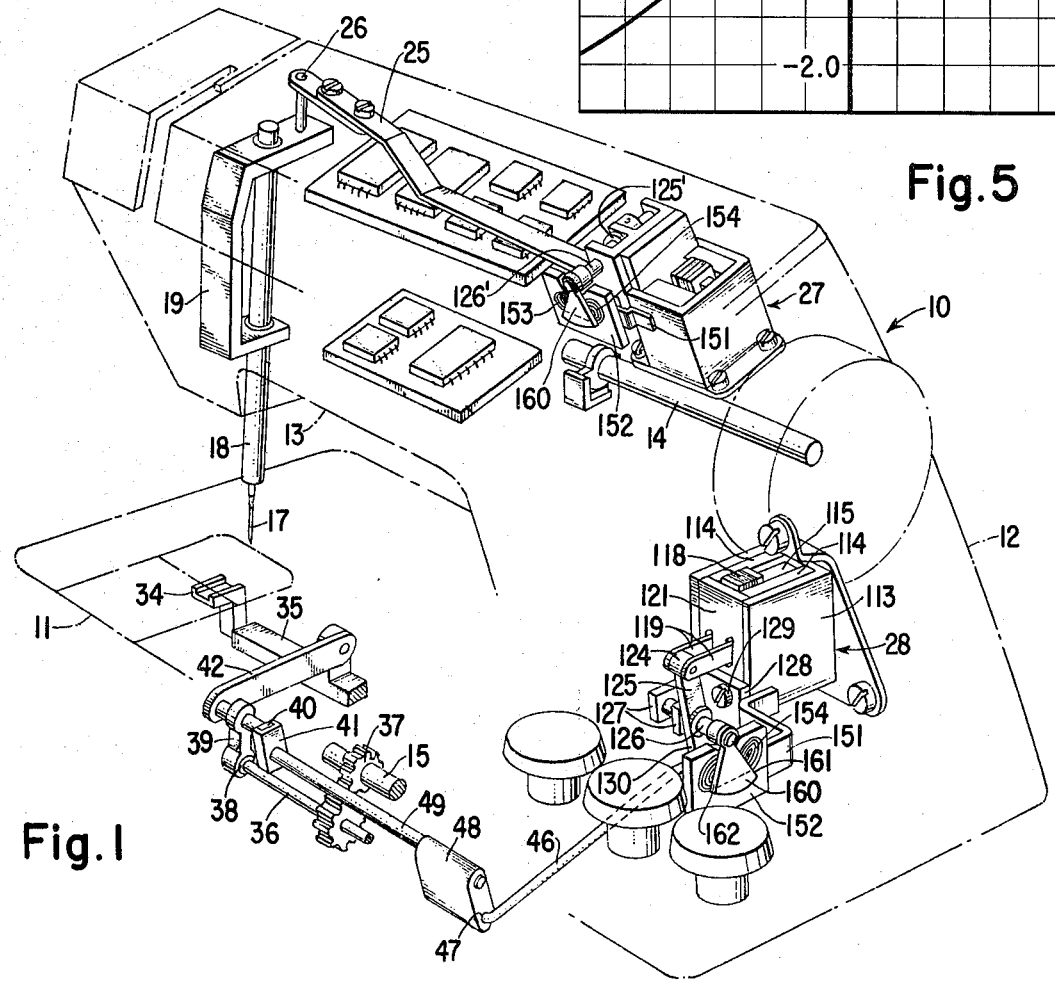
FIG. 1 is a perspective view of a sewing machine including fragments of typical needle jogging and work feeding mechanisms each influenced by an electromechanical actuator which has a position sensing device in accordance with this invention applied thereto.

Shown in phantom lines in FIG. 1 is a sewing machine 10 to which this invention is applied. The sewing machine includes a bed 11, a standard 12 rising from the bed and a bracket arm 13 overhanging the bed. The driving mechanism of the sewing machine includes an arm shaft 14 and a bed shaft 15 interconnected in timed relation by conventional drive mechanism (not shown). A needle 17 is carried for endwise reciprocation by a needle bar 18 mounted for lateral jogging movement in a gate 19 in the bracket arm 13. Any conventional connections (not shown) may be used between the arm shaft 14 and the needle bar for imparting needle reciprocation. A drive link 25 is pivoted as at 26 to the gate 19 and provides the mechanical connection to an electromechanical actuator indicated generally at 27.

Also illustrated in FIG. 1 is a fragment of a work feeding mechanism including a feed dog 34 carried by a feed bar 35. In FIG. 1 the mechanism is illustrated for imparting work transporting movement to the feed dog including the feed drive shaft 36 driven by gears 37 from the bed shaft, a cam 38 on the feed drive shaft, and a pitman 39 embracing the cam 38 and connected to reciprocate a slide block 40 in a slotted feed regulating guideway 41. A link 42 pivotably connects the pitman 39 with the feed bar 35 so that depending upon the inclination of the guideway 41, the magnitude and direction of the feed stroke of the feed dog will be determined.

The inclination of the guideway 41 in the present invention may be controlled by an electromechanical feed actuator indicated generally at 28. The electromechanical feed actuator 28 is connected to a link 46 pivoted at 47 to a rock arm 48 which is secured on a rock shaft 49 to which the guideway 41 is affixed.

The electromechanical actuators 27 and 28 may be constructed alike and may take the form of construction disclosed in detail in the U.S. patent application Ser. No. 431,649, filed Jan. 8, 1974 of Philip Minalga which is incorporated herein by reference. For an understanding of the present invention, the following brief description of the electromechanical actuator 28 should suffice.

The actuator 28 includes a U-shaped magnetically permeable yoke 113 which may be secured to the sewing machine frame by any suitable means. Secured to each of the two inner faces of the yoke is a permanent magnet 114. These magnets are magnetized across the small dimension so as to present the same polarity to the opposed inner faces thereof. A single center leg 115 of magnetically permeable material, positioned centrally between the magnets provides both a flux return path and a guide on which is slidably mounted a bobbin 118 carrying a winding. The bobbin is made of lightweight insulating molded plastic and is formed with lugs 119 which project externally through slots in a magnetically permeable cover plate 121.

The lugs 119 are pivotally connected to one end 124 of a lever 125 having a pivot shaft 126 secured thereto and journaled in lugs 127 of a pivot plate 128 secured to the cover plate 121 as by screws 129. The other end 130 of the lever 125 is pivotally connected to the link 46 which operates the feed regulator shaft 49.

As stated above, the electromechanical actuator 27 is constructed in the same manner as is the actuator 28 and therefore the actuator 27 includes a lever 125' which is carried on a pivot shaft 126' and which is connected to the drive link 25 for jogging the sewing machine needle.

As explained in detail in the above referenced copending U.S. patent application Ser. No. 431,649, filed Jan. 8, 1974, each of the electromechanical actuators 27 and 28 is influenced by an electrical servo-system which compares predetermined electrical pattern signals with reference signals indicative of the actual position of the actuator to drive the actuator successively into the pattern dictated positions. The position sensing device of this invention, which provides the reference signals indicative of the actual position of the actuator, will now be described.

In FIGs. 1 to 4 of the drawing, the position sensing device of this invention is indicated generally at 150, and since the position sensing devices utilized with the electromechanical actuators 27 and 28 are alike, the same reference characters will be used to denote similar parts thereof.

Supported as by a bracket 151 secured to the yoke 113 is a planar electrically non-conductive coil board 152 which may be generally rectangular in shape and which carries on its surface a pair of spaced electrically conductive coils 153–154 which are preferably mirror images of each other. One extremity of each of the coils is directed to a terminal 155 and 156, respectively, located one centrally of each of the coils. The other extremity of each coil is directed to a common terminal 157 equidistant from each of the coils. Preferably, the coils may be provided as printed circuit components deposited as a film on the surface of the coil board 152.

The bracket 151 supports the coil board perpendicular to the axis of the pivot shaft 126 of the actuator 28 (and perpendicular to the pivot shaft 126' of the actuator 27) and the pivot shaft 126 has fixed thereon a metallic shunt plate 160 which is preferably flat and arranged in spaced relation to the coil board 152.

Figure 2:
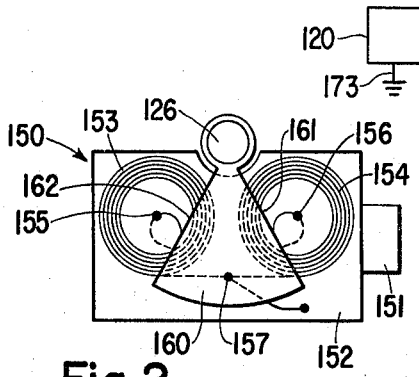
FIG. 2 is a front elevational view of the position sensing device of this invention.

The shunt plate 160 is formed as shown in FIG. 2 perfectly symetrical about a radius extending from the pivot shaft 126 and extends centrally of the shunt plate. The side edges 161 and 162 of the shunt plate preferably are straight and extend radially from the pivot shaft 126 although these side edges may be given any desired configuration albeit each being a mirror image of the other about the central radial line.

The shunt plate 160 is made of non-magnetic metal capable of eddy current conduction. In a prefered embodiment the shunt plate is formed of aluminum.

In the mid-position of the shunt plate as illustrated in FIG. 2, the shunt plate bears exactly the same relationship to each of the coils 153 and 154. In this position of parts, when the coils are excited (parallel driven) by the same exciting voltage, the inductance of each of the coils will be equal. When the pivot shaft 126 is turned in either direction, the attached shunt plate will move correspondingly covering a greater portion of one of the coils and causing the inductance of the covered coil to decrease in proportion to the extent of greater coverage by the shunt plate. This decrease in inductance is due to eddy currents induced into the shunt plate generating a magnetic field opposite to that generated by the coil itself. The change in coil inductance is very closely proportional to the area of coils covered by the shunt plate.

Figure 4:
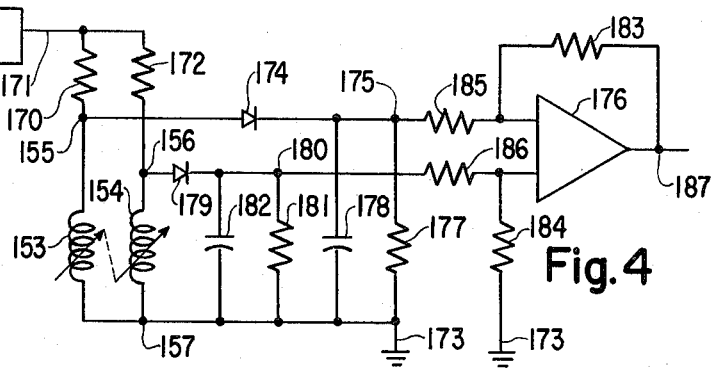
FIG. 4 is a schematic wiring diagram indicating a circuit adapted to respond to the signals generated by the position sensing device of this invention and FIG. 5 is a graph indicating the linearity curve of the response of the position sensing device of this invention.
Figure 3:
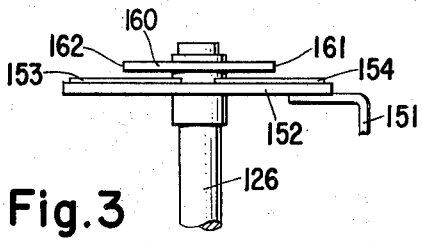
FIG. 3 is a bottom view of the position sensing device shown in FIG. 2.

FIG. 4 illustrates a schematic electrical diagram of an arrangement of components which may be utilized with the position sensing device 27 or 28 to provide a sensor output voltage suitable for use in a servo-system required for operation of the sewing machine of FIG. 1. Indicated at 120 in FIG. 4 is a conventional pulse generator capable of generating a square wave pulse train with a particularly steep rise. Coil 153 has its terminal 155 connected through isolating resistor 170 to the output line 171 of generator 120. Coil 154 has its terminal 156 connected through isolating resistor 172 to the output line 171. The common terminal 157 is connected to ground 173 which is common to the grounded side of the generator 120.

Terminal 155 is connected through diode 174 to one terminal 175 of a differential amplifier 176. Resistor 177 provides the load for diode 174, and capacitor 178 filters out the high frequency components.

Similarly, terminal 156 is connected through diode 179 to the other terminal 180 of the differential amplifier 176. Resistor 181 provides the load for diode 179, and capacitor 182 filters out the high frequency components.

The differential amplifier 176 is a conventional operational amplifier having gain controlling resistors 183, 184, 185 and 186 connected to provide a differential input at terminals 175 and 180 and a single ended output at terminal 187 in a manner well known in this art.

In operation, the reactive voltage generated in coil 153 is substantially equal to $L_1$ (di/dt) where $L_1$, is the inductance of coil 153 and (di/dt) is the rate of change of current in the coil due to the driving square pulse wave applied thereto. After rectification by diode 174, the resultant voltage at terminal 175 is $K_D L_1 - D_1$ where $K_D$ is the driving function determined by the driving voltage magnitude and rise time, and $D_1$ is the voltage drop in diode 174. Similarly, the voltage at terminal 180 is $K_D L_2 - {}_{D2}$ where $L_2$ is the inductance of coil 154 and $D_2$ is the voltage drop in diode 179.

As is well known, the differential amplifier 176 produces on output terminal 187 a voltage $E_o$ equal to the difference between the input voltages on terminals 175 and 180 multiplied by the amplifier gain $K_A$.

Thus $$E_o = K_A\,[(K_D L_1 - D_1) - (K_D L_2 - D_2)]$$

or $$E_o = K_D K_A\,(L_1 - L_2) - (K_A)\,(D_1 - D_2)$$

where:

$E_o$ = Position sensor output voltage
$K_D$ = Driving Function
$K_A$ = Amplifier gain
$L_1$, $L_2$ = Printed coil inductance
$D_1$, $D_2$ = Diode voltage drop
At the center position:

$$L_1 = L_2$$

therefore:

$$E_o^3 = K_A (D_1 - D_2)$$

Note that in the center position, $E_o$ is not a function of $K_D$ which possesses the highest temperature sensitivity because it is determined by the driving voltage rise time and magnitude, and to a lesser degree, frequency. This is especially advantageous in the sewing machine of FIG. 1. Center position accuracy of the actuators 27 and 28 is of prime importance because, for instance, in straight stitch operation (center position) a small throat plate needle aperture provides minimal clearance for the needle. Needle positioning error in this mode of operation could cause the needle to come down on the throat plate, causing the needle to break and possibly injure the operator. Needle positioning error during pattern stitching by comparison is far less serious causing only stitch pattern distortion or offset.

The diode voltage drops $D_1$ and $D_2$ track well with temperature, and any initial offset can be nulled by the conventional system offset adjustment.

In the off center position, $K_D$ comes into play and has a maximum effect at full scale. It has been found that using this invention a maximum of + 10% of point error over a temperature range of +25°F to + 125°F, should be expected at full scale.

The movable shunt plate 160 may be very small having a surface area of about 1 square inch. Formed of aluminum, the moving mass is exceedingly small resulting in negligible mechanical loading or inertia effect upon the operation of the electromechanical actuator.

Interference generated by the coils 153 and 154 is not detectable a short distance away even without shielding because the fields generated by the coils are in opposition.

The compactness of the position sensing device of this invention is suited admirably to incorporation within the close confines of a sewing machine frame.

Figure 5:
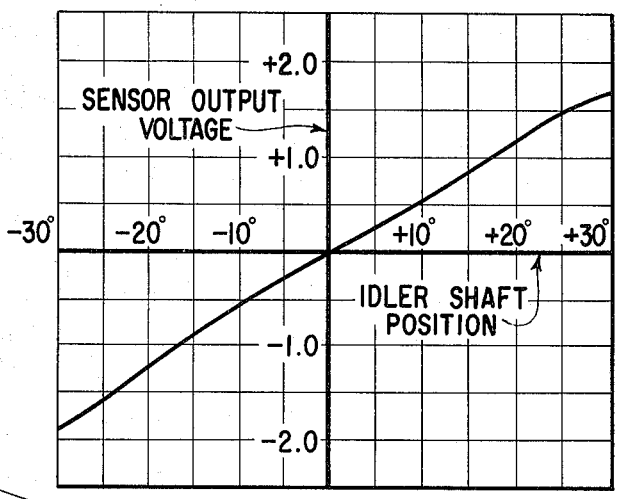

The output characteristic of the position sensing device of the preferred form of this invention is shown in FIG. 5 and is fully compatible with the requirements for such a device as used in the copending U.S. patent application Ser. No. 431,649, Jan. 8, 1974.

The linearity of this sensing device is related to the change in coil inductance responsive to the position of the metallic vane and can be made very accurate by close attention to the symmetry of coil and vane geometry about a center zero position.

A magnetic preferrably non-metallic shunt plate may be used with this invention and will produce an acceptable output which is the mirror image of that depicted in FIG. 5. The higher cost and increased mass of a magnetic shunt plate, however, are factors which are instrumental in the choice of a non-magnetic metallic shunt plate on the preferred embodiment.

Having set forth the nature of this invention, what is claimed herein is:

1. A device for indicating the entire operating range of positions of the actuator of a sewing machine stitch forming instrumentality comprising an electrically non-conductive coil carrying plate, a pair of electrically conductive coils carried on said coil carrying plate in spaced relation and each having a form which is substantially the mirror image of the other coil about an imaginary line midway therebetween, means electrically interconnecting one terminal of each of said coils, a shunt plate for affecting the inductance of said coils, said shunt and coil carrying plates being relatively shiftable, said shunt plate being supported in spaced relation to said coils and having only one position, symmetrical about said imaginary line midway between said coils, in which said shunt plate bears substantially identical physical relationship to each of said coils, an actuator for a sewing machine stitch forming instrumentality, means connected to said actuator for influencing relative shift of said shunt and coil carrying plates varying the inductance in said coils, and an electrical circuit including said coils and responding to the differences in inductance between said coils due to the positioning of said shunt plate to said coils for producing a signal varying in a substantially linear fashion over the operating range of positions of said actuator.

2. A position sensing device as set forth in claim 1 in which said shunt plate comprises a non-magnetic metallic element.

3. A position sensing device as set forth in claim 1 in which the means connected to said sewing machine actuator for influencing relative shift of said shunt and coil-carrying plates comprises a pivot shaft supported on an axis perpendicular to said coil-carrying plate and intersecting the imaginary line midway between said coils, and means securing said shunt plate to said pivot shaft.

4. A position sensing device as set forth in claim 1 in which said coils are deposited as a printed film of electrically conductive material on the surface of said non-conductive plate.

5. A position sensing device as set forth in claim 3 in which said shunt plate comprises a flat aluminum element having a shape which is symmetrical about a center line extending radially from said pivot shaft.

6. A position sensing device as set forth in claim 1 in which said electrical circuit includes means for exciting both of said coils with the same electrical pulses, and signal generating means linearly responsive to the differences in the inductance of said coils in response to said electrical pulses resulting from relative shift of said shunt and coil-carrying plates.

7. A position sensing device as set forth in claim 1 wherein the output from said electrical circuit influences the delivery of an error signal to a servo system for closed loop control of said sewing machine stitch forming instrumentality.

* * * * *